US005727330A

United States Patent [19]

Cucchi et al.

[11] Patent Number: 5,727,330

[45] Date of Patent: Mar. 17, 1998

[54] DEVICE FOR PRODUCING AND USING A HOT AIR JET OBTAINED WITHOUT ELECTRIC RESISTANCES

[76] Inventors: Massimo Cucchi, Via A.Grandi 1, Albinea (RE), Italy, 42020; Oscar Ripamonti, Via D.C.Cazzaniga 9, Merate (CO), Italy, 22055; Ivo Zapparoli, Via F.Parri 2, Carpi, Italy, 41012

[21] Appl. No.: 309,694

[22] Filed: Sep. 21, 1994

[30] Foreign Application Priority Data

Sep. 27, 1993 [IT] Italy ..... MO93A0122

[51] Int. Cl.[6] ..... F26B 13/00

[52] U.S. Cl. ..... 34/86; 34/90; 34/666; 417/371

[58] Field of Search ..... 34/86, 68, 514, 34/515, 366; 417/371, 366, 423.8, 423.14

[56] References Cited

U.S. PATENT DOCUMENTS

| | | | |
|---|---|---|---|
| 2,438,995 | 4/1948 | Forney | 34/91 |
| 2,440,416 | 4/1948 | Proudfoot | 34/86 |
| 2,449,205 | 9/1948 | D'Emilio | 34/90 |
| 3,375,592 | 4/1968 | Heinicke | 34/666 |
| 3,521,978 | 7/1970 | Enemark | 417/371 |
| 3,891,355 | 6/1975 | Hecht | 417/371 |
| 3,991,433 | 11/1976 | Cirino | 34/666 |
| 4,480,967 | 11/1984 | Schulze | 417/371 |
| 4,892,464 | 1/1990 | Schydlo | 417/371 |
| 5,048,202 | 9/1991 | Shero | 34/90 |
| 5,155,924 | 10/1992 | Smith | 34/86 |

FOREIGN PATENT DOCUMENTS

| | | | |
|---|---|---|---|
| 1480225 | 3/1970 | Germany | 34/66 |

*Primary Examiner*—Carl S. Miller
*Attorney, Agent, or Firm*—Stroock & Stroock & Lavan LLP

[57] ABSTRACT

The device comprises a blower (2) with an associated motor (1) which is flange-mounted to it. A flexible tube or hose (6) is connected to the sleeve (7) located on a cap (5) which partially covers the blower (2), and at the other end, to a suction or intake opening (8) of the blower (2). In this way, the sucked air impinges on the motor (1) therefore cooling it, and this air is also preheated, allowing in this way to save energy with respect to a conventional drier having the same operation parameters. The hot air is conveyed from the outlet opening of the blower (2), towards the frusto-conical sleeve (14) which discharges it.

11 Claims, 1 Drawing Sheet

DEVICE FOR PRODUCING AND USING A HOT AIR JET OBTAINED WITHOUT ELECTRIC RESISTANCES

The present invention relates to a device suitable for producing and using a hot air flow, and which can be employed prevalently as a super drier for the toilet of persons and animals and also in any other field of marketable goods or industrial applications in which a hot air flow is needed.

At the present state of the art, the following is known:

a) conventional driers comprising a ventilator which generates an air flow or jet inside a tube wherein one or more electric resistances are disposed for the purpose of heating up the air.

The functional drawbacks of said driers are the following:

high energy consumption;

high noise;

the hot air flow must be concentrated in a small outlet opening, and this may burn the user if the drier is held in a stationary position at the same place and at a small distance;

it tires the user because of the weight he has to support by its hand;

it generates ozone.

b) a plane or table for the drying and the toilet of dogs, cats and other pets, according to the Italian patent application No. MO91A000147 filed in Modena on October 1991 by Cucchi Massimo, Ripamonti Oscar and Zapparoli Ivo, in which a turbine is used in order to obtain:

at the suction side, the intake of water;

at the delivery side, a flow or jet of hot air used as a drier for drying up animals.

The object of the present invention is firstly that of providing a mechanical device which allows to generate a hot air flow without resorting to electric resistances; and secondly, that of generating the hot air flow or jet at the outlet of a flexible hose, thereby obtaining the advantage that no electric motor must be held; but instead, one needs to hold only a simple and very light hose; moreover:

in relation to the operation: besides the handiness and lightness of the hose which discharges the hot air, a large amount of air at high pressure is provided with no risk of causing burns;

in relation to operation costs: the electric energy consumption is reduced by 50% with respect to that required for a drier having the same flow rate, pressure, and temperature values;

in relation to hygiene and safety; no ozone is generated because electric resistances are not employed; no risk of electric discharge exists; there is no noise; there are no external mechanical moving parts;

in relation to maintenance: no maintenance is needed since the electric motor is not of a kind comprising a collector with brushes, and there are no electric resistances which may burn;

due to the small dimensions of the employed blower, it is possible to realize the device:

a) according to an independent version for displacement on the floor and provided with wheels;

b) according to a wall—version, provided or not provided with a pantograph arm—or anyway articulated and extensible-in order to support the hose which discharges the hot air;

c) in such a way that it can be inserted on the pedestal of the chair of a hairdresser room, or on a small piece of furniture placed inside said room.

In both cases, the flexible tube (hose) is applied on a spring-loaded winder of the tube, of a known kind;

d) in such a way that it can be introduced in any container or structure, and so that it can be employed in any field related to marketable goods and/or in an industrial field requiring a jet of hot air.

According to the present invention these objects are attained:

a) by employing a blower of the type MohP, realized for compressing gas or non-explosive mixtures, and which in normal operative conditions heats up air (but not sufficiently for the purposes of the present invention);

b) by partially or completely covering the motor and/or the blower by means of a "cap" which is connected through a tube to the suction opening of the blower itself, said cap having the following two functions:

to cool the motor and the blower allowing their normal operation even if they are closed within a restricted space;

to suck air which is already pre-heated;

c) by adjusting the ratio between the section area of the intake or suction opening of the blower and of the sleeve wherefrom the hot air is discharged, using valves of a known kind.

The features of the invention and its advantages will be more fully understood by reading the following description of a version having the function of a super dryer, the description referring to the annexed drawings which are given only for illustrative and non-limitative purposes, and in which:

BRIEF DESCRIPTION OF THE DRAWINGS

In the different figures, the same numerals refer to the same parts or elements.

Figure 3:
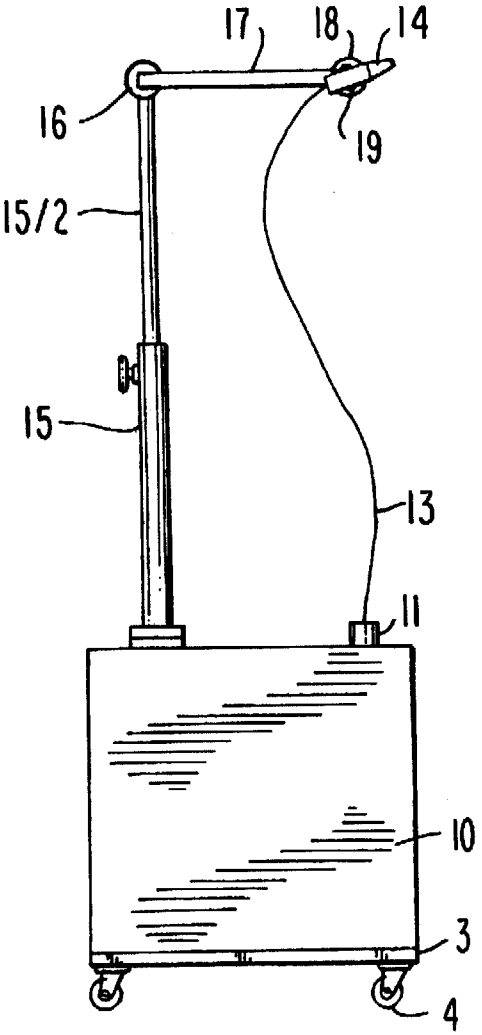
FIG. 3 shows a front view of the device provided with a telescopic arm.
Figure 2:
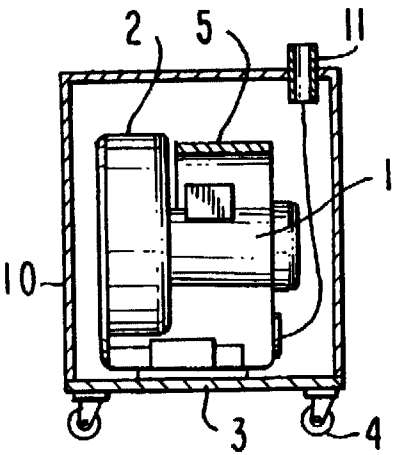
FIGS. 1 and 2 show two diametrical cross sectional views of the device of the present invention, taken orthogonally to each other.
Figure 1:
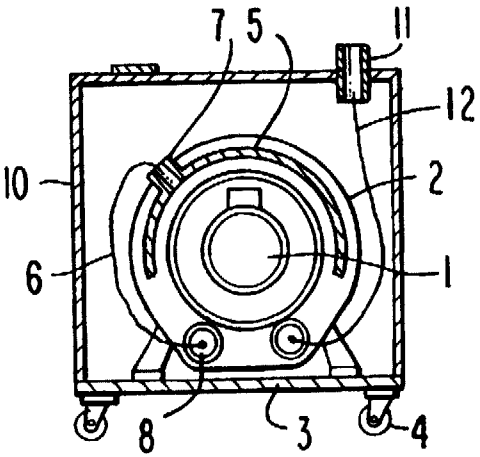

Referring to the above figures, the numeral 1 indicates an electric motor flange-mounted to, the blower 2, which is applied on the base frame 3 carrying wheels 4.

The electric motor 1 is partially covered by a cap or protection element 5, and the intake opening 8 of the blower 2 is connected to the pipe-coupling 7 applied on the cap 5, through a hose schematically indicated by the line 6. In this manner all the air sucked by the blower 2 first gets in contact with the motor 1, thereby cooling it; the air takes away the heat from the external wall of the motor 1 and gets inside the blower 2 when it is already heated up, and then, through its centrifugation and its pressure increase, it heats up even more and gets out of the blower 2 when it has a temperature which is sufficient for being employed in various industrial applications.

An external body 10, having prevalently an aesthetical function supports, a) a pipe-union or sleeve 11 to which there are connected:

on the inside of the body, a hose which is schematically indicated by the line 12 connecting together the sleeve 11 and the outlet opening of the blower 2 discharging the hot air;

on the outside of the body, a hose schematically indicated by the line 13 connecting together the sleeve 11 with a second frusto-conical sleeve 14 from which (therefore) the hot air jet is discharged. This sleeve 14 is used as a dryer;

b) a telescopic arm 15–15/a, placed vertically, at whose upper end there is mounted, by means of an articulated joint 16, a swinging arm 17 at whose distal end 18 there may be provided a second articulated joint carrying an elastic fork 19 in which it is possible to insert, or from which it is possible to remove easily, said frusto-conical sleeve 14;

c) a magnetothermic starter for the motor 1 (not shown). At the intake opening 8 of the blower 2, if needed, it is possible to mount a valve of a known kind (not shown), having the function of gradually decreasing (throttling) the section area of the air passage. A valve of this type may also be applied on the upstream side of the frusto-conical sleeve 14.

The function of these valves is that of varying the ratio between the section areas on the suction and on the blowing side thereby effecting in a noticeable manner the temperature value of the air discharged from the frusto-conical sleeve 14.

The operation as a dryer of the above described device, is as follows:

if the sleeve 14 is supported by the fork 19: the sleeve may be directed in any direction whatever and fixed in that position, so as to direct in a defined direction the jet of hot air;

if the sleeve 14 is unhooked from the fork 19: then, the sleeve 14 can be held by the hand and it can be used as an usual drier.

It is possible to realize and sell a version with wheels (as described and illustrated) or a version without wheels, which can be fixed on the wall.

A version may also be sold, in which there is no body 10 and no telescopic arm 15-16-17-18-19, in order to mount the device wherever it is required to use it.

Obviously, the invention is not limited to the constructive details being illustrated and described, but it comprises also all those variants and equivalent realizations founded on the present inventive concept; therefore, for instance, the cap or protection element 5 may also cover both the motor 1 and the blower 2, partially, or even completely along a closed path; the telescopic arm 15 may be of the pantograph kind or it may be realized in any known manner which serves for the same purpose; the blower 2 may comprise one or more stages; etc.

We claim:

1. A device for producing and using a hot air jet obtained without electric resistances, characterized in that it comprises:

a motor;

a centrifugal blower (2) for providing hot air and driven by said motor, said blower being of the type MohP for compressing one of gases and non explosive mixtures, said blower having a suction opening (8) and an outlet opening for outputting the hot air produced by the blower;

a cap (5) at least partially enclosing at least one of the motor and the blower (2), said cap provided with an intake opening (7);

a tubular duct (6) being connected between the suction opening (8) of the blower (2) and the intake opening (7) of the cap (5) in order to control the flow of air which impinges on the external surface of at least one of the motor (1) and the blower (2);

a flexible tubular duct (12, 13) being connected to the outlet opening of the blower (2), said flexible tubular duct having an opening sleeve to discharge the hot air produced by the blower; and at least two gate valves, said first valve positioned upstream of the suction opening (8) of the blower (2) and a second valve positioned upstream of the opening of the flexible tubular duct in order to allow a fine adjustment of the cross-sectional area defining the air passage to increase the temperature of the air.

2. A device according to claim 1, wherein said motor and blower are mounted on a base having wheels.

3. A device according to claim 1, characterized in that the blower (2) includes at least one stage of operation.

4. A device according to claim 1, characterized in that said cap is connected to the suction opening (8) of the blower (2) through the tubular duct (6) to generate a flow of air to impinge on and cool at least one of the motor (1) and the blower (2).

5. A device according to claim 1, characterized in that said flexible tubular duct discharges hot air and serves as a drier.

6. A device according to claim 1, further including a housing for housing at least said motor and blower.

7. A device according to claim 1, characterized in that said valves vary the cross-sectional area of the air passage of said flexible tubular duct.

8. A device according to claim 1, characterized in that said blower (2) with its associated motor (1), is provided with fixing elements including at least one small feets; pins, and flanges to enable the device to be mounted.

9. A device according to claim 1, further including a telescopic arm (15, 15/a), an external body (10); pipe-unions (7, 11); and a supporting frame (3).

10. A device according to claim 1, further including a rod (15) for supporting said flexible tubular duct.

11. A device according to claim 10, wherein said rod includes an elastic fork for releasably engaging said opening sleeve of said flexible tubular duct.

* * * * *